United States Patent [19]

Mersinas

[11] Patent Number: 4,845,777

[45] Date of Patent: Jul. 11, 1989

[54] RING PROTECTOR

[76] Inventor: Susan M. Mersinas, 8125 S. Farm Rd., Macedonia, Ohio 44056

[21] Appl. No.: 220,475

[22] Filed: Jul. 18, 1988

[51] Int. Cl.[4] ..... A44C 9/00; A41D 13/00

[52] U.S. Cl. ..... 2/021; 63/15.7

[58] Field of Search ..... 2/21; 63/15, 15.5, 15.7, 63/15.8; 132/213, 214, 331, 333

[56] References Cited

U.S. PATENT DOCUMENTS

| | | | |
|---|---|---|---|
| 107,420 | 9/1870 | Spencer | 2/21 X |
| 1,375,690 | 4/1921 | George | 2/21 |
| 4,461,043 | 7/1984 | Lomedico | 2/21 |
| 4,689,828 | 9/1987 | Brewer | 2/21 |
| 4,704,742 | 11/1987 | Foster | 2/21 |

FOREIGN PATENT DOCUMENTS

| | | | |
|---|---|---|---|
| 2183990 | 6/1987 | United Kingdom | 2/21 |

*Primary Examiner*—Werner H. Schroeder
*Assistant Examiner*—Sara M. Current
*Attorney, Agent, or Firm*—Pearne, Gordon, McCoy & Granger

[57] ABSTRACT

This invention relates to a ring protector for use in cutting hair which comprises a generally circular band or ring adapted to fit on a finger having on the outer peripheral edge of said ring a deflector to protect the web between the fingers from a hair-cutting device.

10 Claims, 2 Drawing Sheets

2
16
5
6
10
8
13
12
18
17
14
7
5

5
6
2
15
10
16
8
20
22
4
4
17
24
14
7
5

5
2
10
4
4
24
5

15
6
17
20
16
10
2
22
13
18
8
24
14
12
7

RING PROTECTOR

BACKGROUND OF THE INVENTION

This invention relates generally to a finger ring protector and more specifically to a ring protector useful in cutting hair which comprises a generally circular ring or band adapted to fit on a finger comprising a protector member sufficient in size and thickness to protect the web between the fingers.

Generally finger rings are of many styles and include unitary rings of a fixed size or an adjustable ring having overlapping-end portions capable of being adjusted relative to one another to vary the size of the ring. The unitary finger ring is generally preferred especially since the adjustable rings with overlapping ends have a tendency to protrude or separate from one another over a period of time, thereby enlarging the ring size causing the ring to loosen. For these reasons a unitary ring is preferred which can slip over the finger and can rotate easily about the base of the finger allowing the protector member to cover the web between the fingers.

While there are a number of rings in the prior art disclosing the continuous unitary ring and adjustable rings there are no rings which comprise a protector member on the outer peripheral edge of the ring to protect the webbing between the fingers of a barber or hairdresser. For example, during the dressing or cutting of hair, the operator generally grasps strands of hair between the fingers, e.g. the index and the second finger while cutting the hair with an instrument, i.e. scissors, etc. whereby the points of the scissors have a tendency to strike the webbing between the fingers causing severe injury and bleeding. Attempts to overcome this problem have not been successful particularly for barbers and hairdressers who are relatively new in the field and are more likely to have the tips of the scissors injure the webs between the fingers during the haircutting operation.

SUMMARY OF THE INVENTION

The present invention relates to an adjustable or continuous unitary ring of a fixed size comprising a protector member attached or fixed on the outer peripheral edge of the ring on an axis substantially perpendicular to the axis of the ring. In accordance with this invention, one of the embodiments comprises an adjustable or unitary ring comprising a ring or band having an aperture therein for receiving the finger of the wearer and a protector member on the outer edge or periphery of the ring and extending toward the adjacent finger and is sufficiently wide and of such length to protect the webbing between the fingers.

Accordingly, it is an object of this invention to provide a generally circular ring including adjustable and unitary rings with a protector member at a place on the outer peripheral edge of said ring to protect the webbing between the fingers of the wearer.

Other features and advantages of this invention will become apparent from a more detailed description of the preferred embodiments set forth hereinbelow.

DETAILED DESCRIPTION

Figure 2:
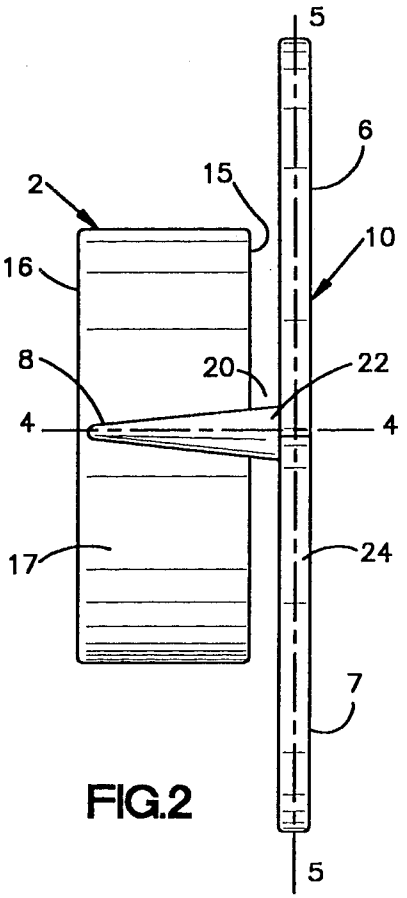
FIG. 2 is a top view of the unitary ring shown in FIG. 1.
Figure 1:
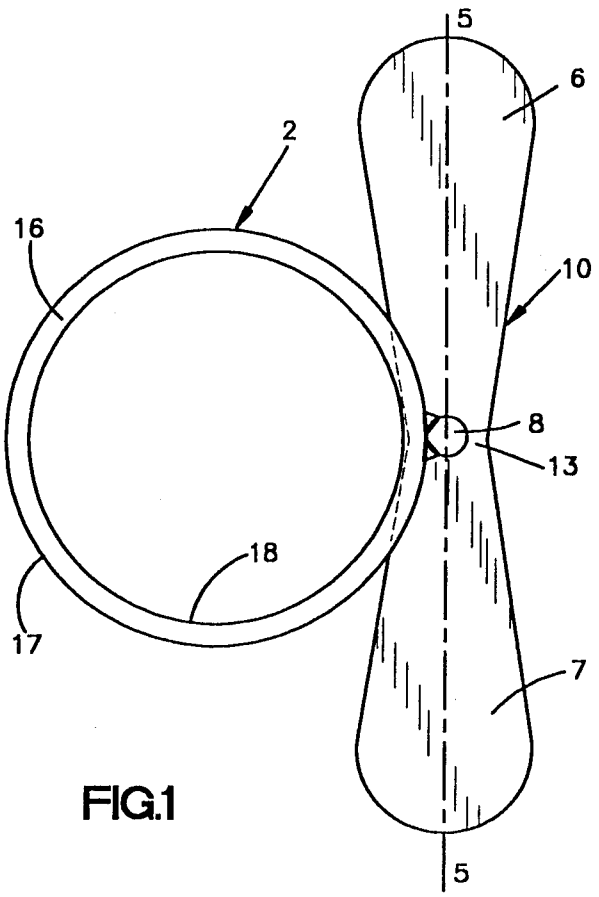
FIG. 1 is a side elevational view of a unitary ring with the protector member on the outer edge of the ring.

Referring to FIGS. 1 and 2, the unitary ring comprises an annular band or ring member 2 for encircling a finger having an inner diameter surface 18 which engages the surface of the finger, an outer diameter surface 17 opposite the inner diameter surface and a protector member 10. In the drawings, like reference numerals apply to similar parts throughout the various view with the numeral 2 generally applying to the band or ring.

Figure 3:
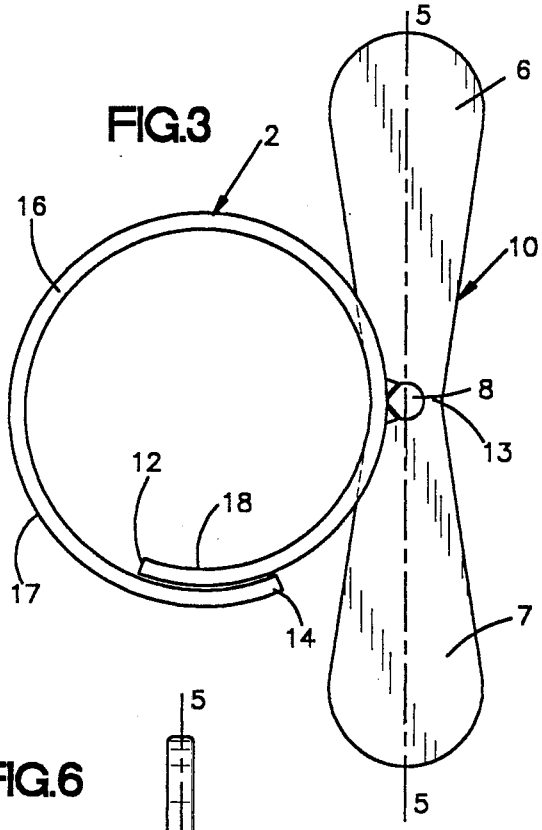
FIG. 3 is a side elevational view of an adjustable ring with the protector member on the outer edge of the ring.
Figure 4:
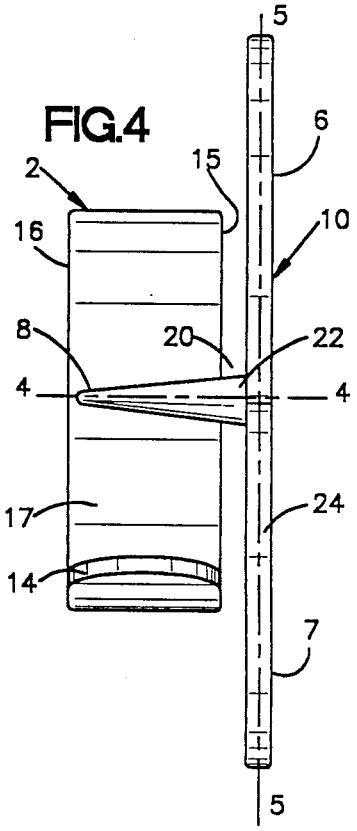
FIG. 4 is a top view of the adjustable ring as shown in FIG. 3.
Figure 5:
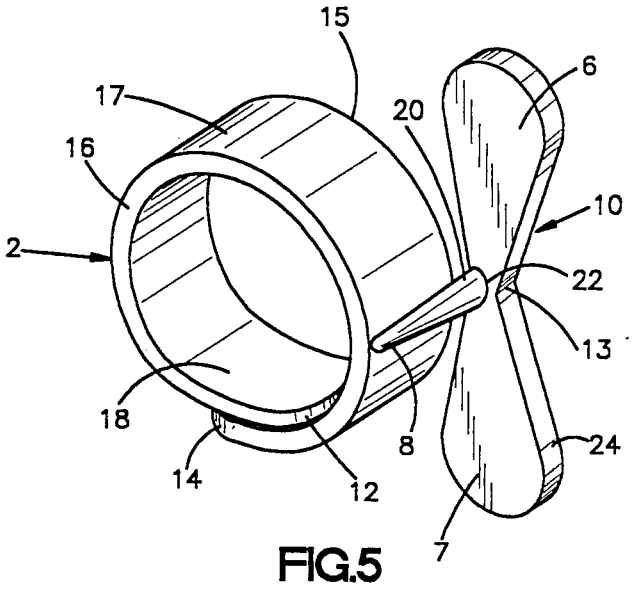
FIG. 5 is a prospective view of an adjustable ring with the protector wherein the overlapping ends are adjustable relative to one another to vary the size of the ring.

FIGS. 3–5 illustrate an elongated strip or band formed in a circular configuration with its end portions 12 and 14 disposed in overlapping relationship. The band or ring 12 may be prepared from various materials, preferably materials such as metal or plastic e.g. polyethylene or polypropylene and the like. The adjustable ring may be further characterized as a radially thin band constituting a major portion of its length which is resiliently expandable and contractible as shown in FIGS. 3 and 5. Thus, the ring can be fitted onto any portion of the wearer's finger from the base to the tip, but generally will fit snugly at the base of the finger.

More specifically, as shown in FIGS. 3 and 4, the ring or band 2, characterized as an adjustable ring, has an outer peripheral edge 15 and an inner peripheral edge 16 with adjustable overlapping ends 12 and 14. As shown in FIGS. 2 and 4, the outer diameter surface 17 of the ring 2 has a post 8 thereon extending transversely away from the outer peripheral edge 15 on an axis line 4—4 of the ring which is substantially perpendicular to the axis line 5—5 of the protector member 10. The post 8 extends transversely beyond the outer peripheral edge 15 of the ring to a point at hte top 22 providing sufficient space 20 between the outer edge 15 of the ring 2 and the protector member 10 to allow the protector member 10 to be adjusted laterally to protect the webbing between the fingers. The post extension or space 20 may vary in distance from 1/16 to $\frac{1}{4}$ 4 of an inch. The protector member 10 may be either fixed by various means e.g. by a pin (not shown) to the top 22 of the post 8 or consist as a unitary part of the ring i.e. tangent to the ring as shown in FIG. 6.

More specifically, as shown in FIG. 5, at a point on the outer diameter surface 17 of the band or ring 2 is a post 8 extending transversely beyond the outer edge 15 of the ring. At the top 22 of the post 8 is a protective member 10 e.g. a propeller which is adapted to be worn on the outside of the wearer's finger. As shown in FIGS. 1–4, the protector member 10 is on an axis line 5—5 which is substantially perpendicular to the center axis line 4—4 of the ring. The protector member 10 is sufficiently wide at its center 13 to extend toward the adjacent finger to protect the web between the fingers.

As shown in FIGS. 1 and 2 the inner diameter surface 18 of the unitary ring is equidistant from the ring's center axis 4-4. On a place or point on the outer diameter surface 17, a post 8 extends transversely from the outer peripheral edge 15 by the extension 20 shown in FIG. 2. The protector can be an integral part of or attached to the top 22 of post 8, extending outward from the outer peripheral edge 15 of the ring as shown in FIGS. 2 and 6. The protector member 10 may comprise a pair of deflectors 6 and 7 having the configuration of a unitary propeller. Each deflector 6 and 7 of the propeller extends in opposite direction from one another and is on an axis 5—5 substantially perpendicular to the axis line 4—4 of the ring. The deflectors 6 and 7 can be of any design or shape e.g. a propeller and can be a unitary or separate members mounted to the top 22 of the post 8 on an axis shown by line 5—5 which is perpendicular to the axis 4—4 of the ring. This enables the deflectors 6 and 7 to be vertically adjusted to protect the web between the fingers. The deflectors 6 and 7 are easily adjustable at the top 22 of the post 8 because of the distance or space 20 between the top 22 of the post 8 and the outer peripheral edge 15 of the ring. The post 8 may be of various shapes i.e. cone-shaped extending both outwardly and transversely from the ring's outer surface 17 toward the adjacent finger. The protector member 10 is located at the top 22 of the post 8 at a sufficient distance from the outer peripheral edge 15 of the ring.

Figure 6:
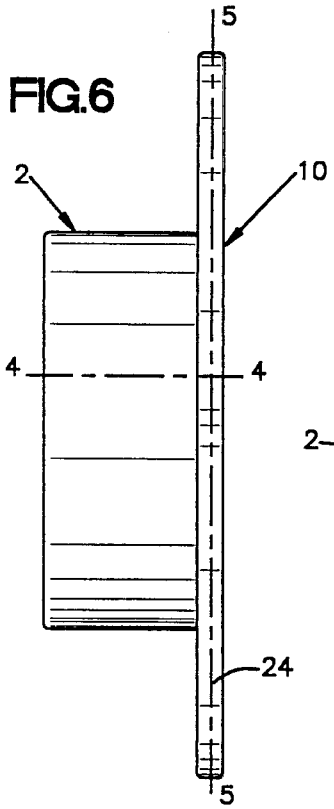
FIG. 6 is an end elevationsl view of a unitary ring with the protector member tangent to the outer peripheral edge of the ring.

As an alternative, the protector member 10 comprising deflectors 6 and 7 may be tangent to the outer peripheral edge 15 of the ring 2 particularly when it is desirable to maintain the deflectors on an axis perpendicular to the axis 4—4 of the ring as shown in FIG. 6. Where the protector member 10 e.g. propeller is tangent to the outer peripheral edge 15 of the ring, it is more difficult to adjust the deflectors with respect to the webbing between the fingers due to the rigidity of the blade. Accordingly, it is desirable to provide an extension 20 of the post 8 from the edge of the ring whereby the deflectors 6 and 7 can be adjusted with respect to the web between the fingers to obtain maximum protection. In that case the axis of the deflectors may not be perpendicular to the axis 4-4 of the ring, but may be on an angle with respect to the ring axis. The width, size and shape of the protector member 10 e.g. propeller or deflectors 6 and 7 are not critical in that the deflectors 6 and 7 need only have a thickness 24 sufficient to protect the webbing between the fingers.

Similarly, the length of the propeller blades or deflectors 6 and 7 may vary, and it is essential only that said deflectors extend transversely beyond the outer circumference of the ring to protect the finger web as shown in FIGS. 1-5. The ring or band 2 may have alternative designs which may include, for example, mid-way between the length of the band, a radially thickened and transversely widened surface to form a post or area which is substantially rigid, due to its greater bulk as compared to the rest of the band, from which extends the protector member. Again, the protector member 10 e.g. propeller can be attached either to a post on the outer surface 17 of the ring as shown in the drawings or tangent to the outer peripheral edge 15 of the ring as shown in FIG. 6.

While this invention has been described with respect to a number of specific embodiments, it is obvious that there are other variations and modifications which can be made without departing from the spirit and scope of the invention set forth in the appended claims.

The invention claimed is:

1. A ring protector for use in cutting hair which comprises a generally circular ring adapted to fit on a finger to protect the web between the fingers and a protector member on the outer peripheral edge of said ring; said protector member comprising a vertically adjustable deflector having its longitudinal axis substantially perpendicular to the axis of the ring and extends toward the adjacent finger to protect the web between the fingers from a haircutting device.

2. The ring protector of claim 1 further characterized in that the protector member extends from a post on the outer peripheral edge of the ring and comprises a pair of adjustable deflectors extending in opposite direction on an axis substantially perpendicular to the axis of the ring.

3. The ring protector of claim 1 further characterized in that the protector member is tangent to the outer peripheral edge of the ring.

4. The ring protector of claim 1 further characterized in that the protector member extends from a post on the outer peripheral edge of the ring; said post extending transversely from the peripheral outer edge of the ring and toward the adjacent finger.

5. The ring protector of claim 4 further characterized in that the ring protector comprises a circular ring with its end portion disposed in an overlapping relation.

6. The ring protector of claim 4 further characterized as a unitary ring.

7. The ring protector of claim 4 further characterized in that the protector member extends outward from the outer surface of the ring on an axis substantially perpendicular to the ring axis.

8. The ring protector of claim 4 further characterized in that the post extends outward from the outer peripheral edge of the ring on an axis substantially parallel to the ring axis.

9. The ring protector of claim 4 further characterized in that the protector member has the configuration of a propeller.

10. The ring protector of claim 9 further characterized in that the ring protector is metal.

* * * * *